US007465881B2

(12) United States Patent
Lin

(10) Patent No.: US 7,465,881 B2
(45) Date of Patent: Dec. 16, 2008

(54) COUPLER STEM ASSEMBLY

(75) Inventor: Wei-Chung Lin, Birmingham, AL (US)

(73) Assignee: MacLean-Fogg Company, Mundelein, IL (US)

( * ) Notice: Subject to any disclaimer, the term of this patent is extended or adjusted under 35 U.S.C. 154(b) by 0 days.

(21) Appl. No.: 11/051,718

(22) Filed: Feb. 4, 2005

(65) Prior Publication Data

US 2006/0175079 A1 Aug. 10, 2006

(51) Int. Cl.
*H01B 17/26* (2006.01)

(52) U.S. Cl. ..... 174/152 R; 174/650; 174/165; 411/383

(58) Field of Classification Search ..... 174/140 R, 174/205, 165, 142, 174, 185, 196, 188, 195, 174/140 C, 650, 137 R, 152 R; 411/383
See application file for complete search history.

(56) References Cited

U.S. PATENT DOCUMENTS 5,413,443 A * 5/1995 Aghamehdi ..... 411/383

* cited by examiner

*Primary Examiner*—Angel R Estrada
(74) *Attorney, Agent, or Firm*—Dana Andrew Alden

(57) ABSTRACT

The present invention relates to a coupler stem assembly including a coupler and a stem, the coupler includes a polymer material that has been molded to a predetermined shape, an outer surface that is threaded and provided with a coupler axis, and an inner surface that defines a cavity and that includes a retaining member, the stem includes an outer stem surface that is provided with a stem axis and that is shaped to fit within the cavity defined by the inner surface of the coupler; and a retaining surface that is located on the outer stem surface and shaped to cooperate with the retaining member of the inner surface of the coupler.

10 Claims, 18 Drawing Sheets

COUPLER STEM ASSEMBLY

FIELD OF THE INVENTION

The present invention pertains to a method and apparatus for mounting a threaded coupler, for securing an insulator, onto a stem.

BACKGROUND OF THE INVENTION

Power lines (also known as "conductors") are supported by power line poles, which may be wooden, metal or other typically used materials. The power lines, such as electrical transmission or distribution lines, are mounted to primary insulators. Primary insulators are typically made of a ceramic material or a synthetic polymer material and have various shapes and designs depending on the required voltage rating. The interior of the primary insulator is typically threaded in order to mate with a threaded element (also known as an "insulator thread") in accordance with the dimensions specified by ANSI C 135.17 (1988), either for a one inch or a one and three-eighths inch thread.

The threaded element, with which the primary insulator mates, is typically formed on a pin, which is directly or indirectly mounted to the power line pole. As used herein, the term "pin" includes any conventionally used rod-like element adapted for insertion into the interior of a threaded element for a primary insulator. Known pins include brackets, spacers, attachments and the like. As disclosed in U.S. Pat. No. 5,413,443, the entire disclosure of which is hereby incorporated herein, pins are usually metal or fiberglass or fiberglass with metal ends and can be mounted at the top of a power line pole (i.e. pole-top pin) or on the side of a power line pole (i.e. side pole pin).

After mounting the primary insulator on the threaded element, the assembled unit must be resistant to rotational and tensile forces. Such forces can be caused by movement, or galloping, of the power line as a result of wind, or sudden dropping of ice or snow from the power line, or other forces. Excessive rotational forces could inadvertently be applied to the unit during installation of the primary insulator on the threaded element. Finally, the threaded element is preferably self-lubricating or easily conforming to the contour of the internal insulator thread to facilitate installation of the primary insulator on the threaded element.

To meet these needs, lead has been used in the industry as the material for the threaded element. Lead has a low melting point, is pliable and is self-lubricating. However, lead has been listed as a hazardous material by the Environmental Protection Agency and other authorities. Therefore, there is reason to avoid the use of lead as a material for the threaded element.

One such effort involves forming a threaded element with an inner diameter which increases along its length from the top to the bottom of the threaded element. Such a threaded element would have a generally constant thickness along its length because the above-mentioned ANSI specification requires that the outer diameter of the threaded element also increase along its length from top to bottom. An adhesive resinous material is placed between the inner diameter of the threaded element and the outer surface of the pin. In such a system, the point of least resistance to an upward tensile force on the primary insulator (and thus on the threaded element) is the relatively weak bond between the threaded element and the epoxy.

SUMMARY OF THE INVENTION

The scope of the present invention is defined solely by the appended claims, an is not affected to any degree by the statements within this summary. Briefly stated, coupler stem assembly embodying features of the present invention comprises a coupler that includes a polymer material that has been molded to a predetermined shape, an outer surface that is threaded and provided with a coupler axis, and an inner surface that defines a cavity and that includes a retaining member, and a stem that includes an outer stem surface that is provided with a stem axis and that is shaped to fit within the cavity defined by the inner surface of the coupler; and a retaining surface that is located on the outer stem surface and shaped to cooperate with the retaining member of the inner surface of the coupler.

DETAILED DESCRIPTION OF THE PRESENTLY PREFERRED EMBODIMENT

Figure 1:
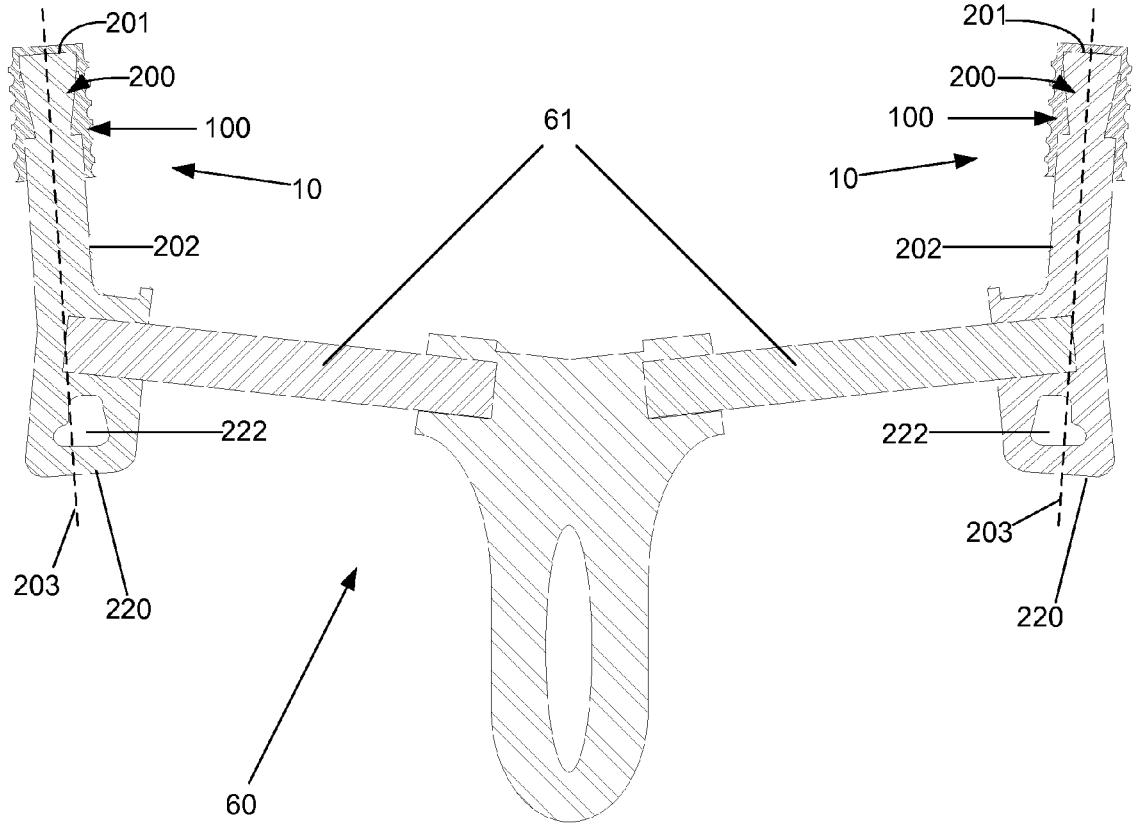
FIG. 1 depicts a cross-sectional view of the preferred embodiment of a coupler stem assembly.

FIG. 1 depicts the presently preferred embodiment of coupler stem assembly 10 of the present invention. As shown therein, the preferred embodiment includes a coupler 100 and a stem 200. The coupler 100 and the stem 200 preferably cooperate to secure an insulator (not shown) to across arm, such as cross arm 60 depicted in FIG. 1. The coupler 100 preferably secures an insulator on which is mounted a power line (as known as a conductor), such as a transmission or distribution line. The insulator is provided with internal threads that are capable of coupling with a threaded surface 107 located on the outer surface 106 of the coupler 100, as shown in FIG. 2.

The coupler 100 preferably includes a polymer, such as, for example, a plastic, a polycarbonate, or a nylon. The coupler 100 preferably includes a lubricating material, such as, for example a molybdenum sulfate, which increases the lubricating properties of the polymer.

Figure 2:
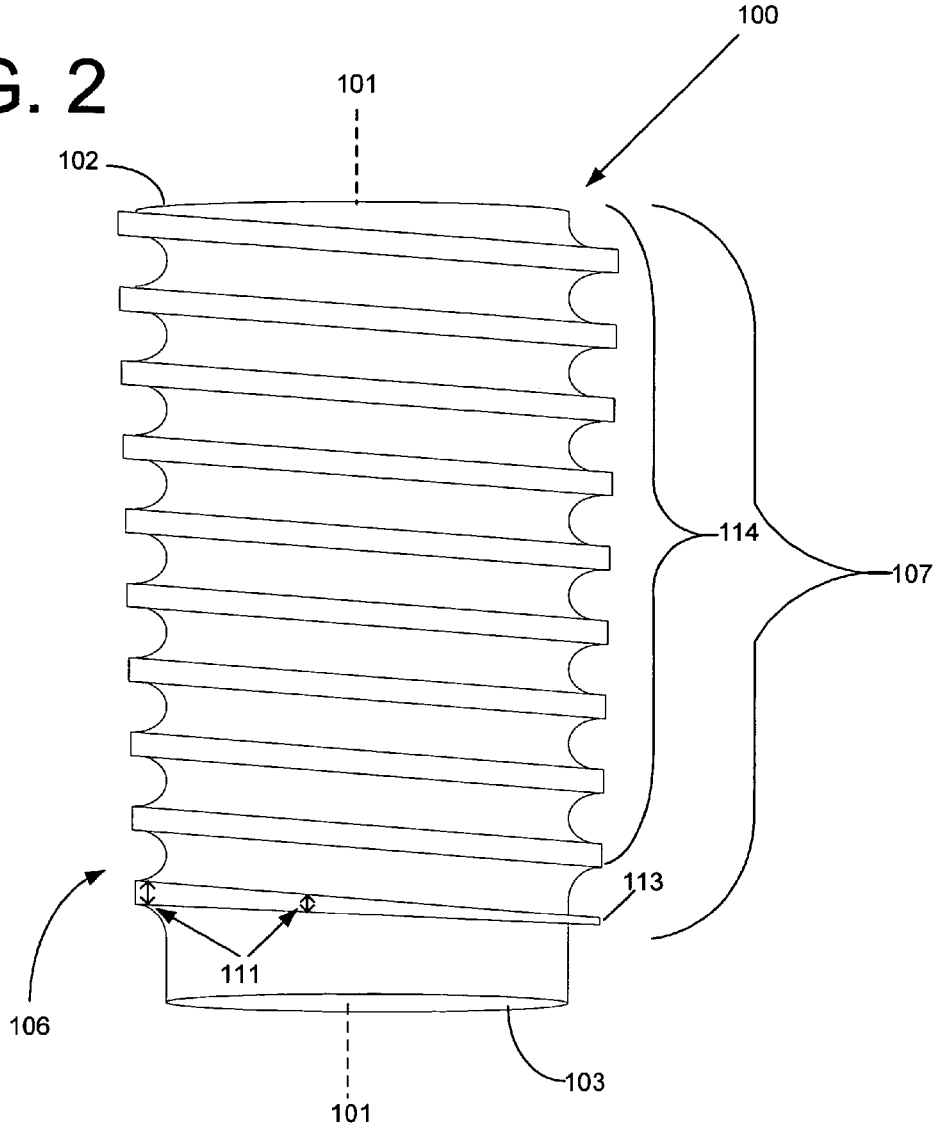
FIG. 2 depicts a side perspective view of a coupler of the preferred embodiment.
Figure 3:
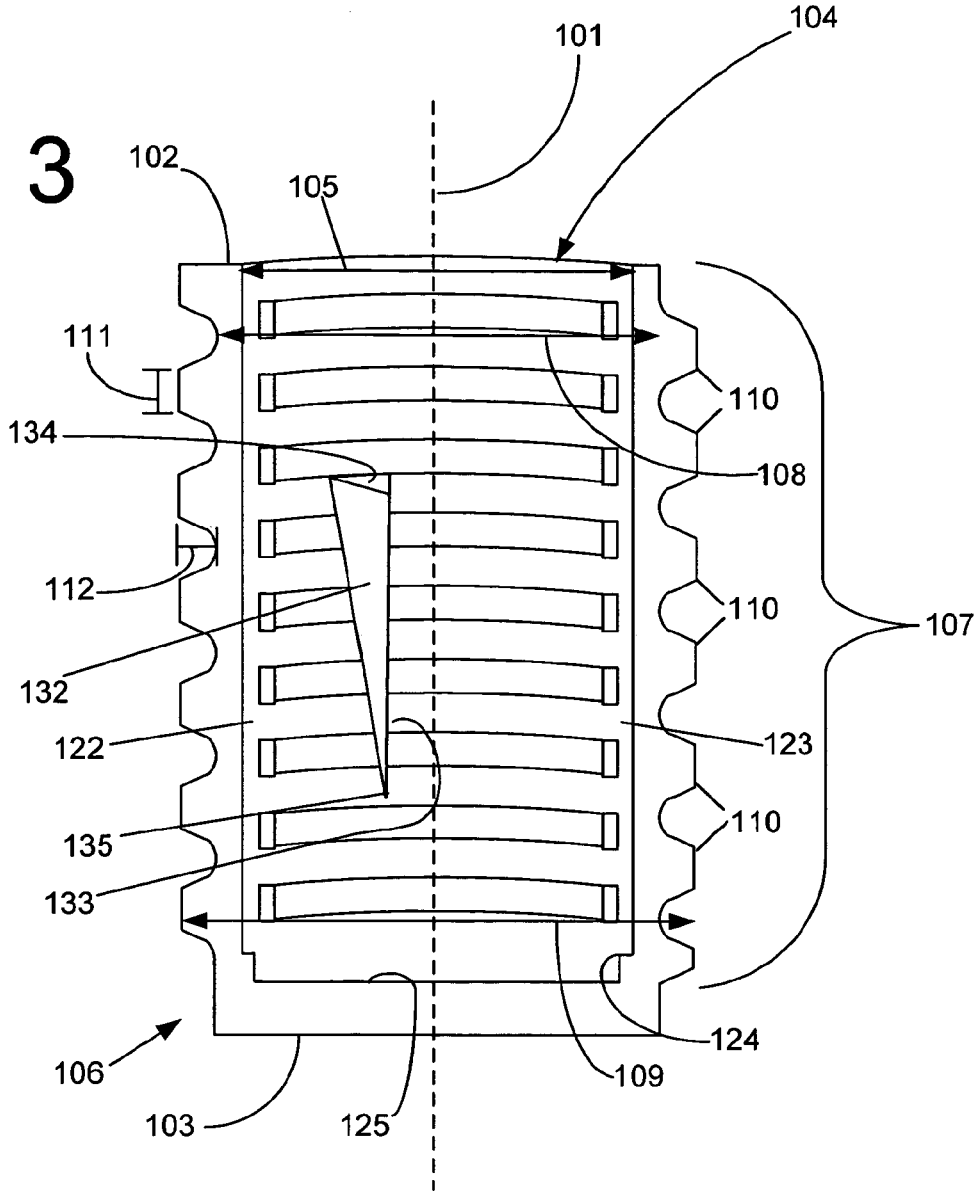
FIG. 3 depicts a cross-sectional view of a coupler of the preferred embodiment.
Figure 4:
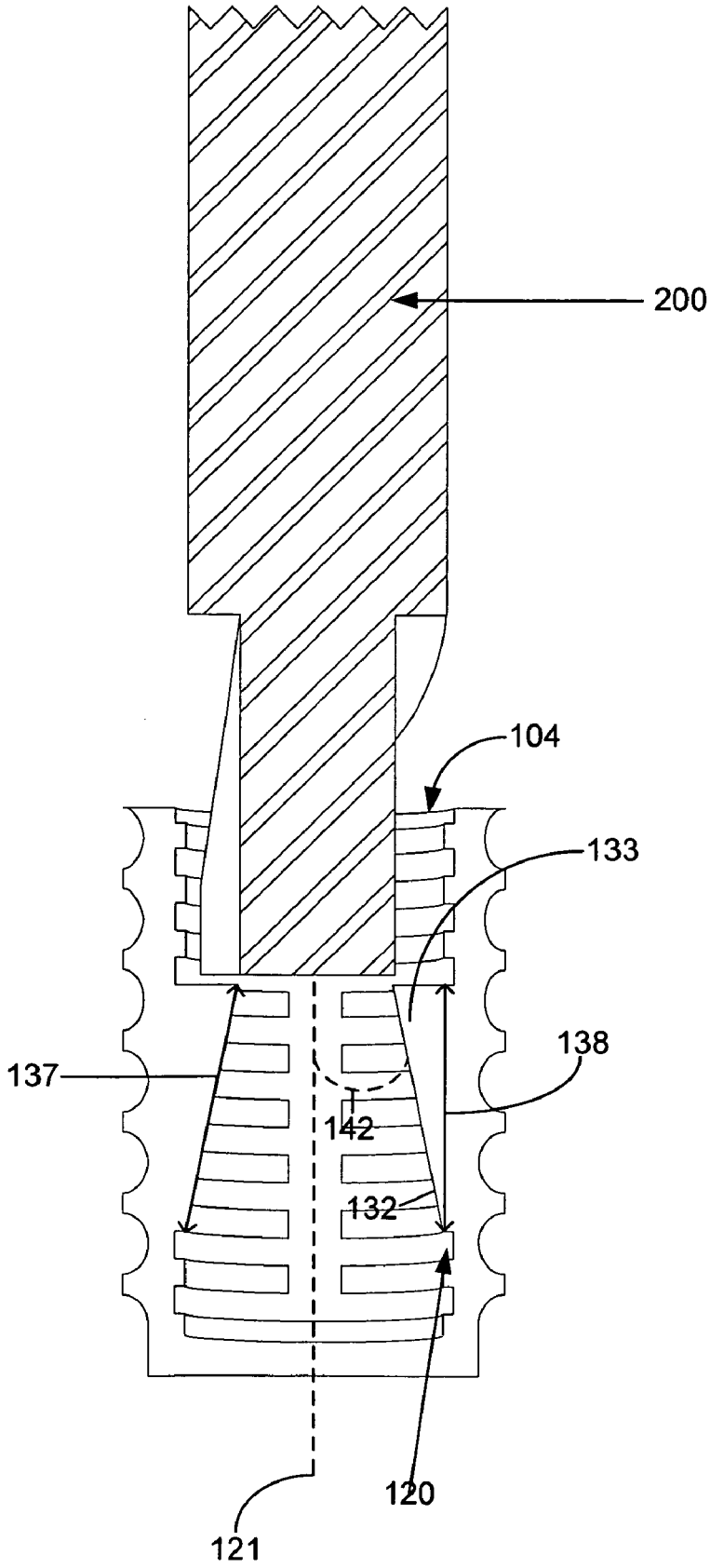
FIG. 4 depicts a cross-sectional view of a coupler and stem of the preferred embodiment.

As shown in FIG. 2, the coupler 100 is generally cylindrical in shape. In an alternative embodiment, however, the coupler 100 is generally frusto-conical in shape. The coupler 100 includes a coupler axis 101, a first coupler end 102, and a second coupler end 103. As shown in FIG. 3, the first coupler end 102 is provided with an opening 104. In an alternative embodiment, the second coupler end 103 is provided with an opening (not shown). Referring now to FIG. 4, the opening 104 is shaped to accept at least a portion of a stem 200. The opening 104 is preferably generally circular in shape and, as shown in FIG. 3, provided with a diameter 105 that. The diameter 105 is dimensioned according to the stem 200 and ranges from 0.550 inches to 0.700 inches, preferably 0.625 inches.

As shown in FIGS. 2 and 3, the coupler 100 includes an outer surface 106 that is provided with the couplet axis 101. The outer surface 106 is shaped to be secured to an insulator. In the preferred embodiment, the outer surface 106 extends about the coupler axis 101 in a generally frusto-conical manner. In an alternative embodiment, the outer surface 106 extends about the coupler axis in a generally cylindrical manner. The outer surface 106 is configured to secure an insulator to a cross arm 60, preferably thorough a threaded surface 107, which couples with the insulator.

As depicted in FIG. 3, the threaded surface 107 is provided with a minor diameter 108 and a major diameter 109. Also shown therein, the threads 110 include a thread width 111 and a thread height 112. In the presently preferred embodiment, the major and minor diameters 108, 109 increase from the second coupler end 103 to the first coupler end 102. In an alternative embodiment, the major diameter 109 increases from the second coupler end 103 to the first coupler end 102, while the minor diameter 108 remains constant. In yet another alternative embodiment, the major diameter 109 and the minor diameter 108 remains constant from the second coupler end 103 to the first coupler end 102.

FIG. 2 depicts the threaded surface 107 in greater detail. As shown therein, the threaded surface 107 is provided with a plurality of thread configurations 113, 114. The threaded surface 107 is provided with an aligning thread 113. According to one aspect of the present invention, the aligning thread 113 is configured to prevent cross-threading. According to another aspect of the present invention, the aligning thread 113 is configured to orient the threads 51 of an insulator 50 so that the threads 51 of the insulator 50 align with the threaded surface 107 on the coupler 100.

As shown in FIG. 2, the aligning thread 113 is located at the second coupler end 103 and located helically about the coupler axis 101. The presently preferred embodiment is provided with a single turn of aligning thread 113, however, an alternative embodiment is provided with a plurality of turns of aligning thread 113, such as, for example, two or three turns of aligning thread 113.

Figure 5:
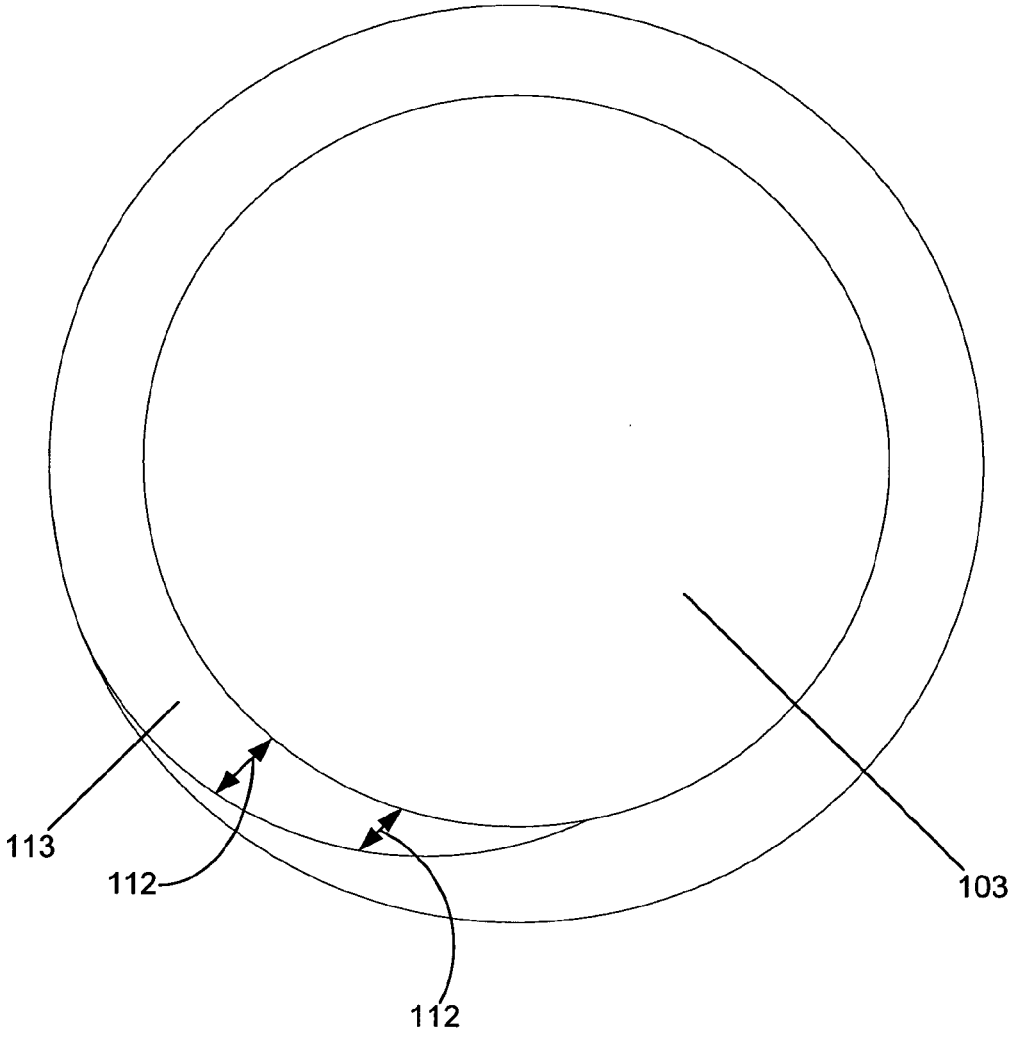
FIG. 5 depicts an end perspective view of a coupler of the preferred embodiment

Referring now to FIG. 2, the thread width 111 of the aligning thread 113 is shown increasing from the second coupler end 103 towards the first coupler end 102. Additionally, as shown in FIG. 5, the thread height 112 of the aligning thread 113 preferably increases from the second coupler end 103 towards the first coupler end 102.

The threaded surface 107 is provided with a plurality of engaging threads 114. Referring now to FIG. 2, the engaging threads 114 are located adjacent to the aligning threads 113. As shown therein, the aligning threads 113 transition into the engaging threads 114. The engaging threads 114 are configured to engage the threads on an insulator to secure the coupler 100 to an insulator.

Figure 6:
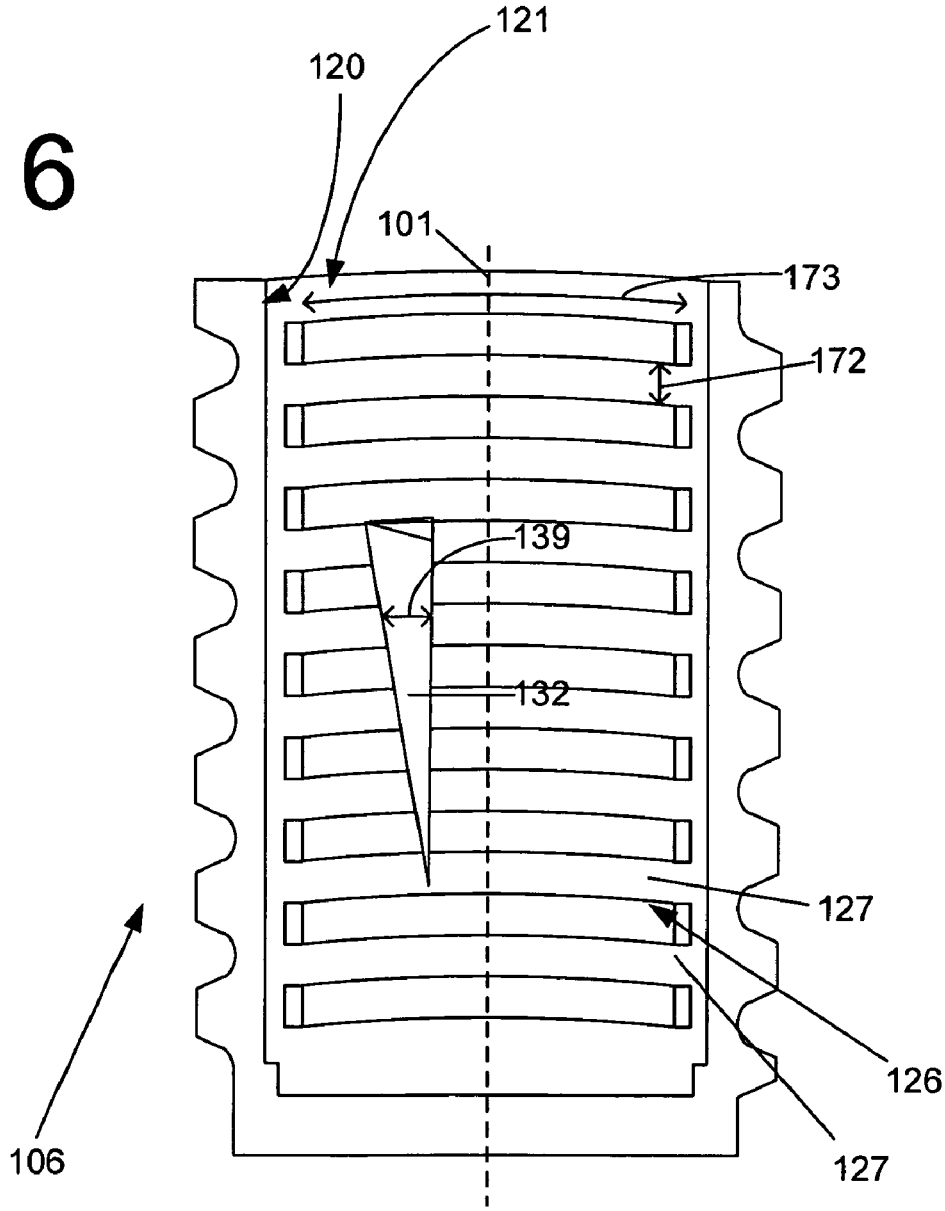
FIG. 6 depicts a cross-sectional view of a coupler of the preferred embodiment.

Turning now to FIG. 6, the outer surface 106 encloses an inner surface 120. Referring now to FIG. 4, the inner surface 120 is dimensioned to accept at least a portion of the stem 200. Returning to FIG. 6, the inner surface 120 defines a cavity 121 that is shaped according to an outer stem surface 202 of the stem 200. As shown therein, the inner surface 120 and cavity 121 are generally cylindrical in shape; however, in an alternative embodiment, the inner surface 120 and cavity 121 are generally frusto-conical in shape.

The inner surface 120 includes at least one slot 122 that extends axially from the opening 104. The slot 122 preferably extends from the opening 104 to near an inner end surface 125. As shown in FIG. 3, the slot 122 preferably extends from the opening 104 to a stepped surface 124 that is preferably located adjacent to the inner end surface 125; however, in an alternative embodiment, the slot 122 extends from the opening 104 to the inner end surface 125.

According to one aspect of the preferred embodiment, the slot 122 is shaped to retain an adhesive. According to another aspect of the preferred embodiment, the slot 122 is shaped to retain a resin. According to yet another aspect of the preferred embodiment, the slot 122 is shaped to retain an adhesive resinous material, such as, for example, an epoxy, a thermosetting material, or a thermoplastic material.

Figure 7:
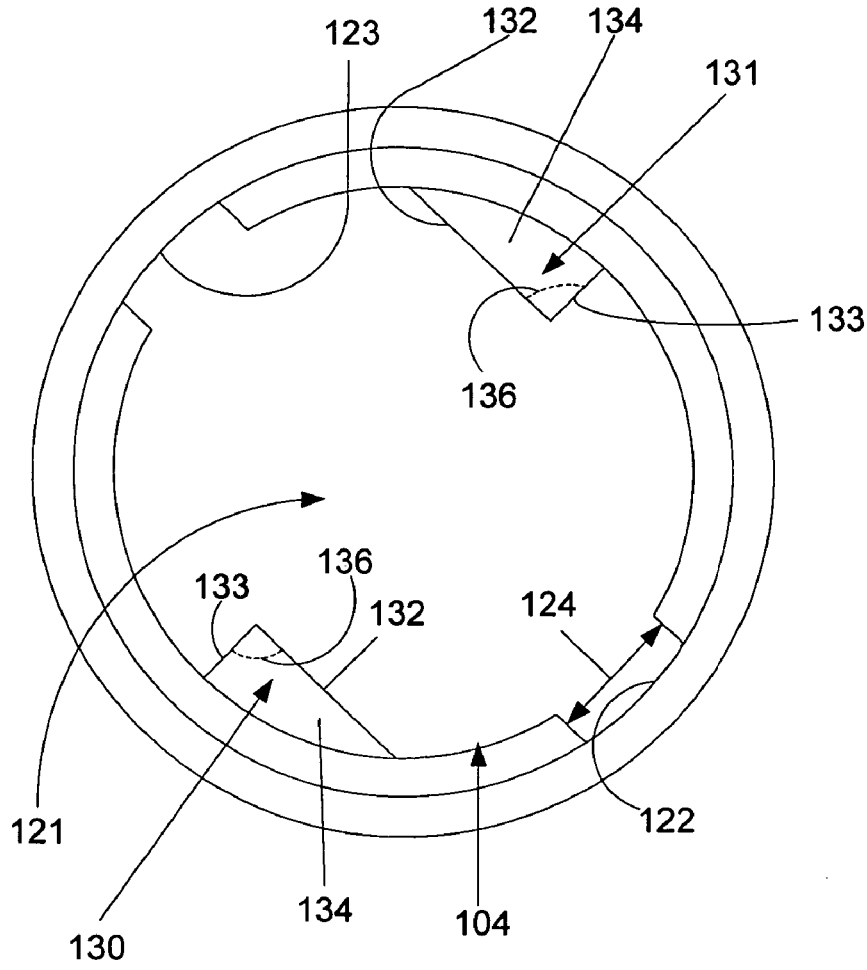
FIG. 7 depicts a perspective view of a coupler of the preferred embodiment.

In the preferred embodiment, depicted in FIG. 7, the inner surface 120 is provided with a pair of slots 122, 123. As shown therein, the pair includes a first slot 122 and a second slot 123 that are oriented at 180° from each other. In alternative embodiments, the inner surface 120 includes a plurality of pairs of slots 122, 123, wherein each pair of slots 122, 123 includes a first slot 122 and a second slot 123 that are located at 180° from each other. The number of pairs of slots 122, 123 ranges from one pair to ten pairs.

Figure 8:
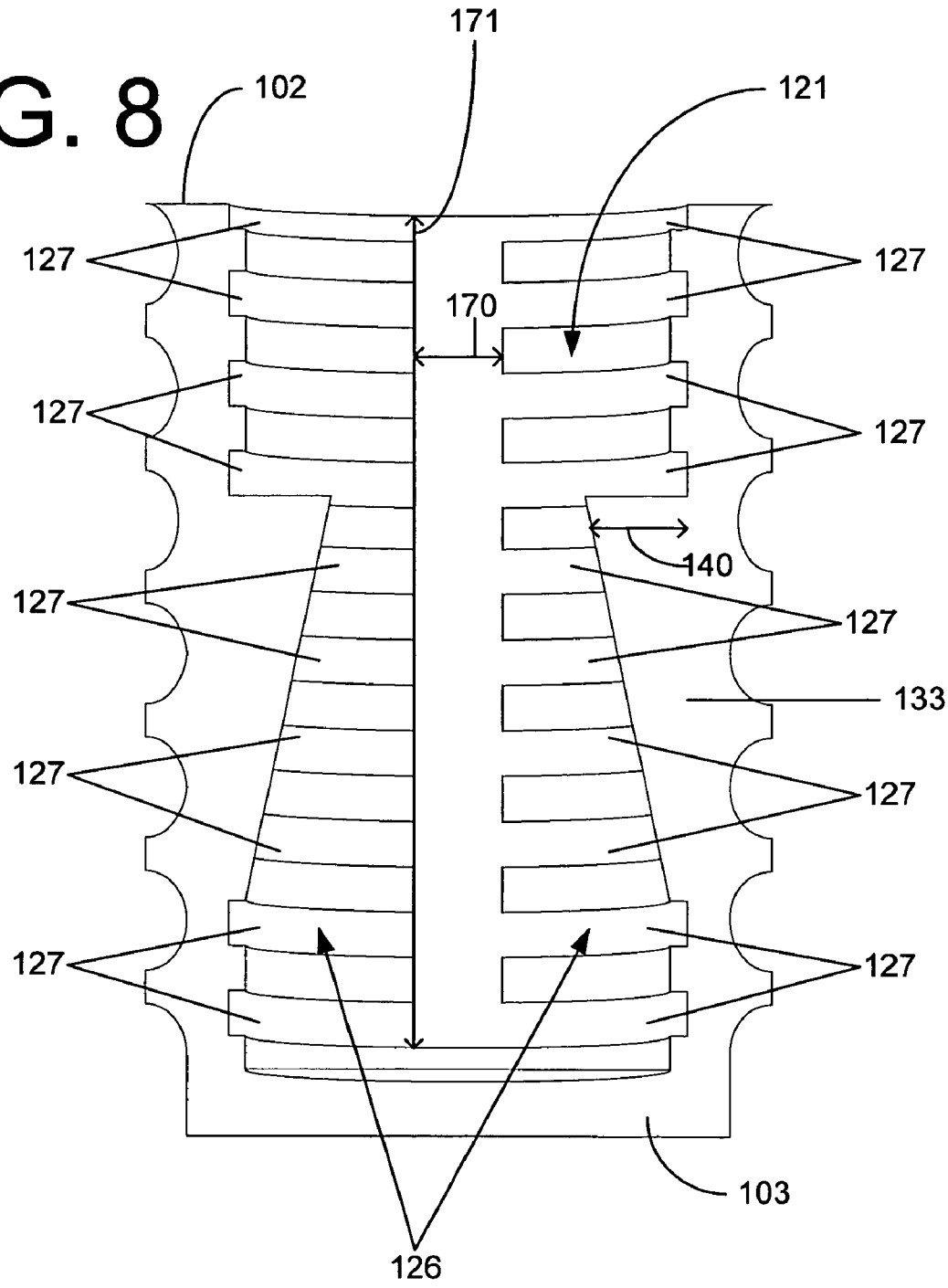
FIG. 8 depicts a cross-sectional view of a coupler of the preferred embodiment.

In the preferred embodiment, the slots 122, 123 are recessed with respect to at least a portion of the inner surface 120. The slots are preferably provided with a generally rectangular shape. As shown in FIG. 8, the slots 122, 123 are provided with a slot width 170 which extends radially with respect to the axis 101 and a slot length 171 that extends axially into the cavity 121, preferably from the first coupler end 102. In the preferred embodiment, the slot length 171 is greater than the slot width 170.

In the preferred embodiment depicted in FIG. 6, the inner surface 120 is provided with a ridged surface 126 that is configured to retain an adhesive. The ridged surface 126 is located radially about the coupler axis 101. According to another aspect of the preferred embodiment, the ridged surface 126 is shaped to retain a resin. According to yet another aspect of the preferred embodiment, the ridged surface 126 is shaped to retain an adhesive resinous material, such as, for example, an epoxy, a thermosetting material, or a thermoplastic material.

As shown, the ridged surface 126 is located radially with respect to the coupler axis 101 and axially from the opening 104. In the embodiment depicted in FIG. 6, the ridged surface 126 is achieved through a plurality of depressions 127 that extend axially from the opening 104 and radially with respect to the coupler axis 101. The depressions 127 ate recessed with respect to at least a portion of the inner surface 120. In the embodiment depicted, the depressions 127 are provided with a depression width 172 and a depression length 173. As shown therein, the depression length 173 extends radially with respect to the axis 101 and the depression width 172 extends axially. In the preferred embodiment, the depression length 173 is greater than the depression width 172.

Figure 9:
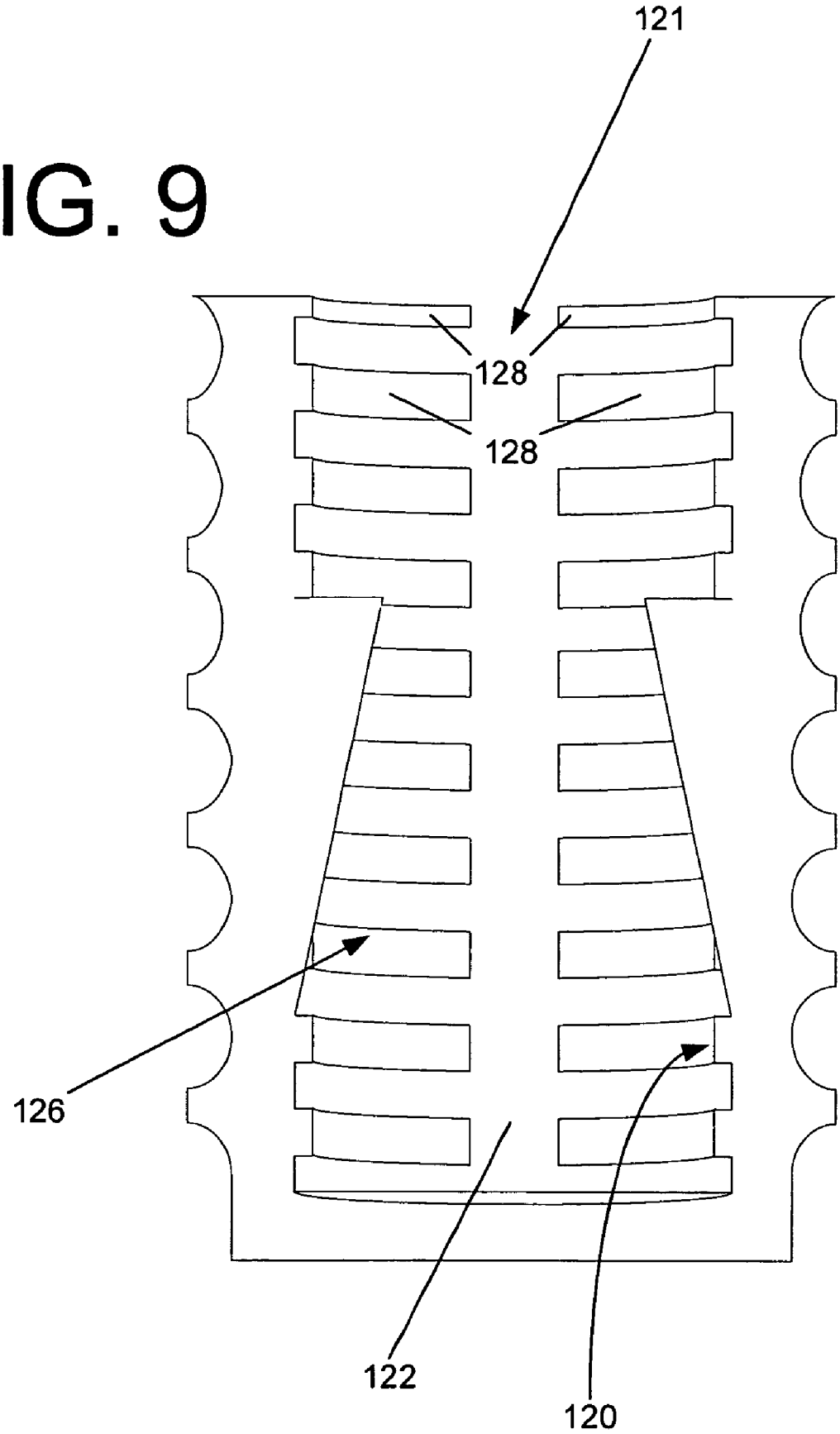
FIG. 9 depicts a cross-sectional view of a coupler of an alternative embodiment.

FIG. 9 depicts an inner surface 120 of an alternative embodiment. As shown therein, the ridged surface 126 and slots 122, 123 are achieved through a plurality of protrusions 128. As shown therein, the plurality of protrusions 128 are raised with respect to at least a portion of the inner surface 120. In the embodiment depicted, the plurality of protrusions 128 are shaped to define the slots 122, 123.

Figure 10:
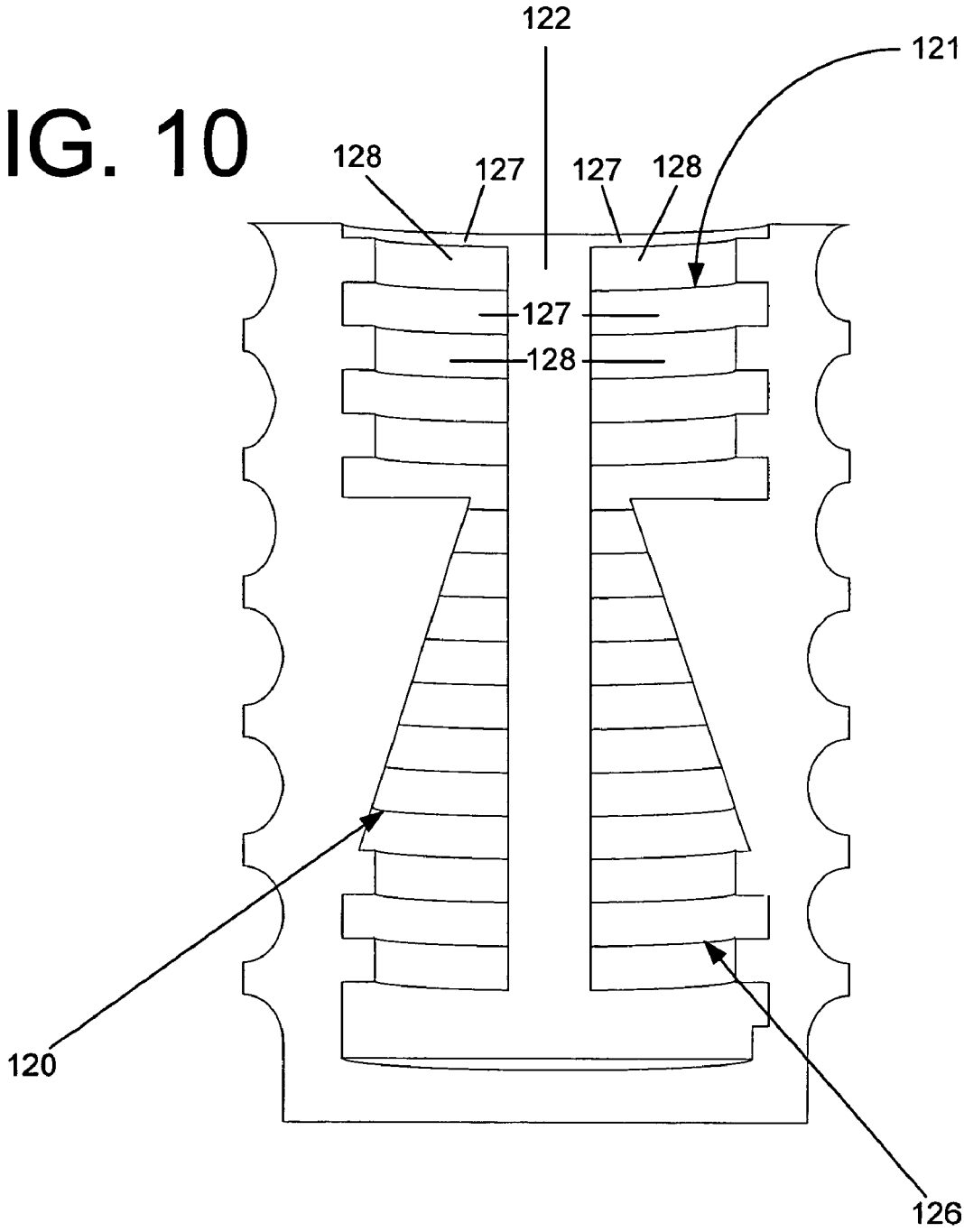
FIG. 10 depicts a cross-sectional view of a couplet of an alternative embodiment.

FIG. 10 depicts an inner surface 120 of another alternative embodiment. As shown therein, the inner surface 120 is provided with a plurality of slots 122, 123 which are recessed with respect to at least a portion of the inner surface 120. Also shown therein, the ridged surface 126 is achieved through a plurality of protrusions 128 and depressions 127. In the embodiment depicted the slots 122, 123 and depressions 127 are recessed with respect to the protrusions 128. In the alternative embodiment depicted, the depressions 127 are recessed with respect to the slots 122, 123, however, in further alternative embodiments, the slots 122 and 123 are recessed with respect to the depressions.

The inner surface 120 includes at least one retaining member 130; however, as shown in FIG. 7, it is preferred that the inner surface 120 be provided with retaining members 130, 131 in pairs, wherein each pair includes a first retaining member 130 and a second retaining member 131 located 180° from each other. In the preferred embodiment depicted in FIG. 7, the inner surface 120 is provided with two retaining members 130, 131 located at 180° from each other.

As shown in FIG. 7, the retaining members 130, 131 are preferably provided with a first surface 132, a second surface 133, and a third surface 134. The third surface 134 is located adjacent to the first surface 132 and the second surface 133 and is provided with a generally triangular shape. The first and second surfaces 132, 133 extend from the third surface 134 toward the second end 103 to an end point 135. The first surface 132 abuts the second surface 133 at an angle 136 so that the retaining members 130, 131 form a generally triangular cross-sectional shape and are dimensioned to fit within the respective grooves 206, 207 on the stem 200. Preferably, the angle 136 between the first surface 132 and the second surface 133 measures 90°.

As shown in FIG. 4, the first and second surfaces 132, 133 are provided with respective lengths 137, 138, which are preferably substantially equal. The length 137 of the first surface 132 is dimensioned according to the retention distance 217 of retention surfaces 204, 205 on the stem. The length 137 of the first surface 132 preferably corresponds to the retention distance 217 of the retention surfaces 204, 205.

As shown in FIGS. 6 and 8, the first 132 and second sides 133 are provided with respective widths 139, 140. The width 139 of the first surface 132 is tapered so that the dimension of the width 139 decreases along the axial length 137. As shown in FIG. 8, the width 140 of the second surface 133 is tapered so that the dimension of the width 140 decreases along the axial length 137. In the preferred embodiment, the widths 139, 140 taper towards the second coupler end 103. In the preferred embodiment, the widths 139, 140 are less than the respective lengths 133, 138.

Figure 11:
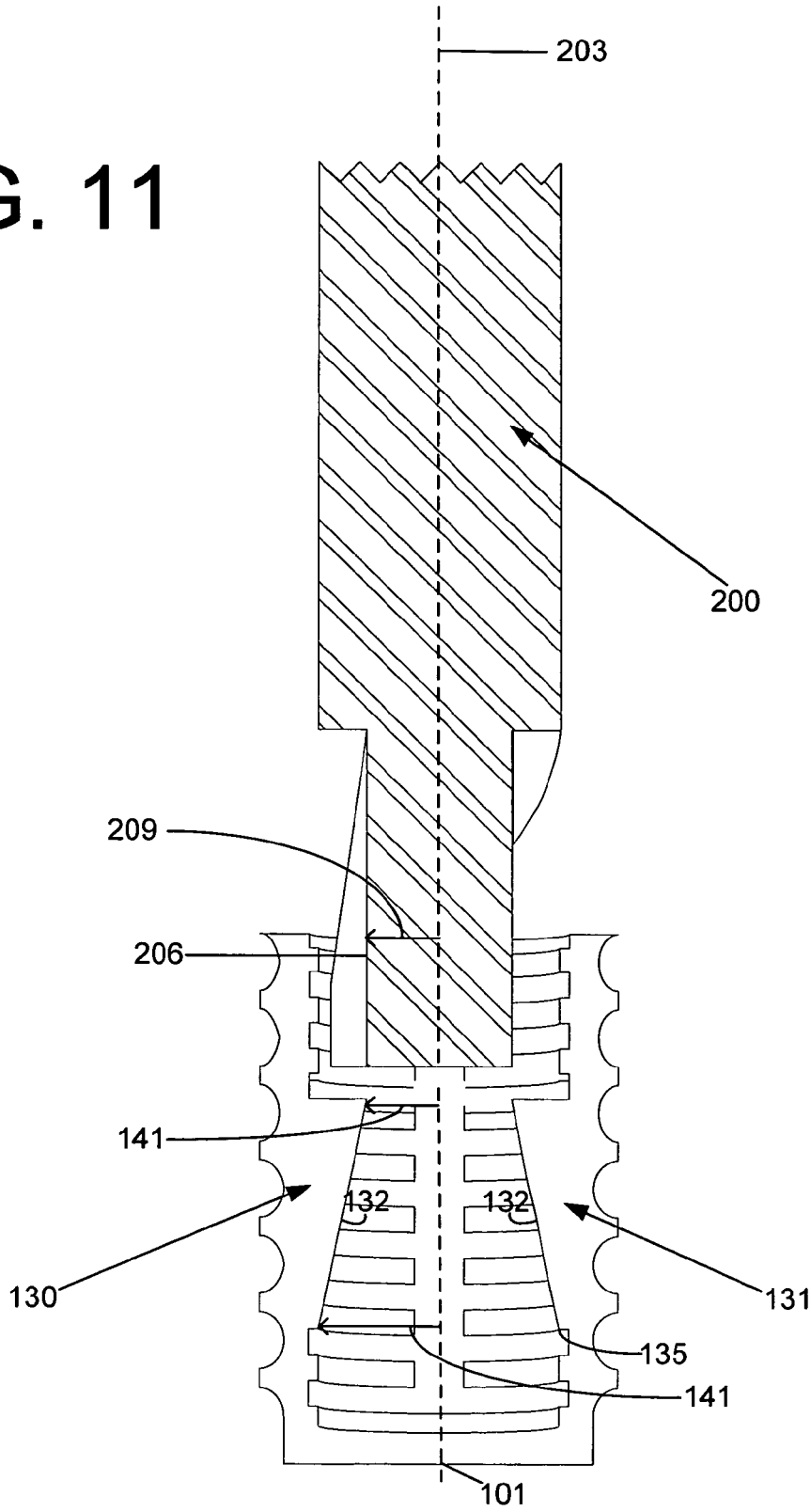
FIG. 11 depicts a cross-sectional view of a coupler and stem of the preferred embodiment.

According to one aspect of the presently preferred embodiment, the retaining members 132, 133 are configured so that the inner surface 120 accepts the stem 200. The coupler 100 is provided with a coupler radius 141 that is measured from the coupler axis 101 to one of the retaining surfaces 130, 132, as shown in FIG. 11. The coupler radius 141 is dimensioned so that the respective grooves 206, 207 on the stem 200 receive the respective retaining members 130, 131. As shown in FIG. 11, the coupler radius 141 is dimensioned to be greater than or equal to a groove radius 209 of the stem 200.

According to another aspect of the present invention, the retaining members 130, 131 are configured to prevent separation of the coupler 100 from the stem 200. In the preferred embodiment, the retaining members 132, 133 prevent axial movement of the coupler 100 with respect to the stem 200. In the preferred embodiment, depicted in FIG. 12, the coupler radius 141 decreases along the axial length 137 towards the first coupler end 102. Advantageously, the coupler radius 141 at third surfaces 134 measures less than a retaining radius 208 of the stem 200 at the termination point 216. As a result, the first surface 132 of the retaining members 131, 132 interlock with the respective retaining surfaces 204, 205 and the coupler 100 cannot be separated from the stem 200 when the first sides 132 of the retaining members 130, 131 are in contact with the respective retaining surface 204, 205.

In the preferred embodiment, the first sides 132 of the retaining members 130, 131 are angled correspondingly to the retaining surfaces 204, 205 of the stem 200. As shown in FIG. 4, the first surfaces 132 are at an angle 142, with respect to the coupler axis 101. The angle 142 is greater than 0° and less than 90°, preferably less than 30°.

Figure 13:
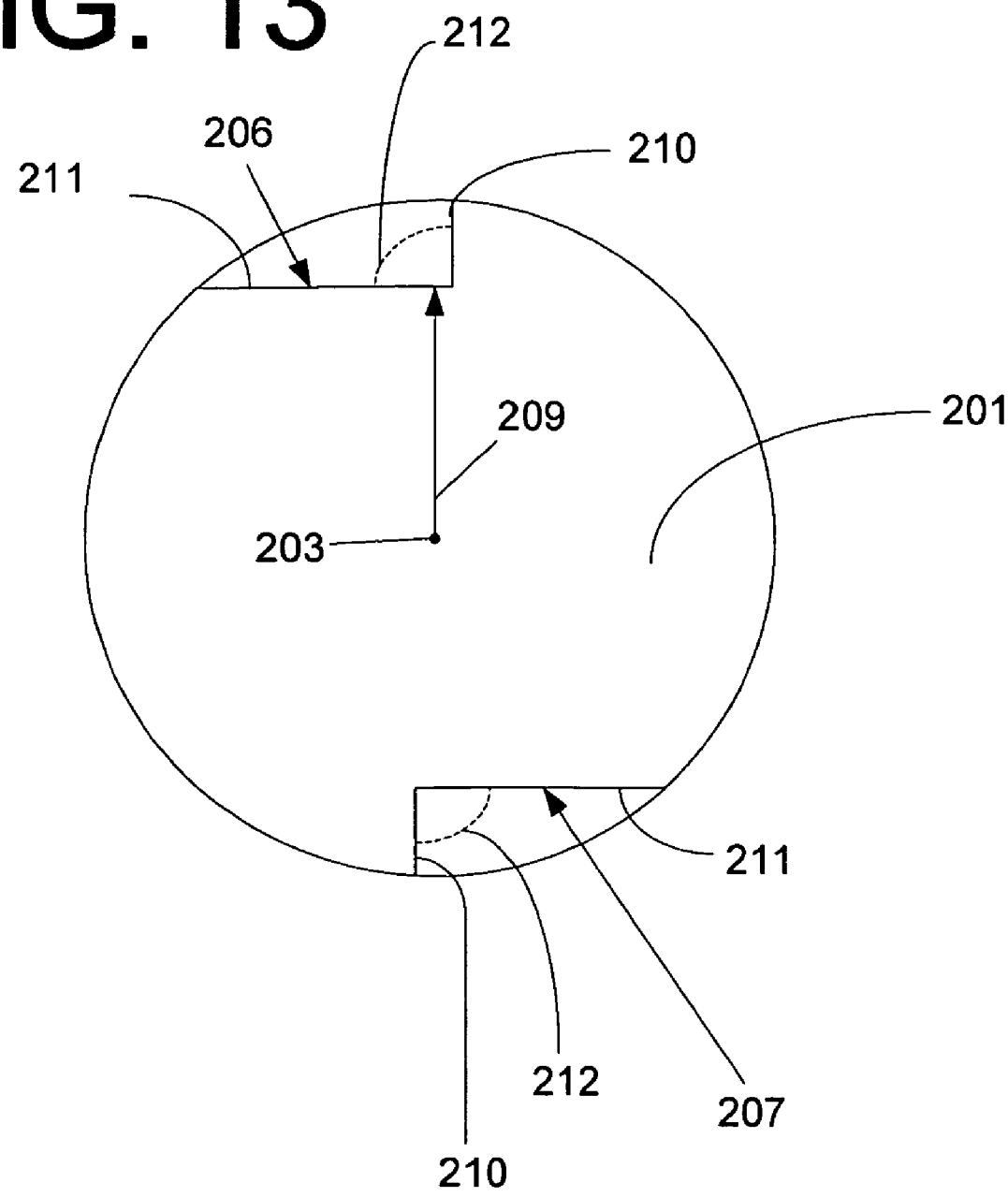
FIG. 13 depicts an end perspective view of the stem of the preferred embodiment.

Turning now back to FIG. 1, the cross arm 60 preferred embodiment includes a stem 200. The stem 200 is fabricated from a fiberglass or a metal, such a steel, an aluminum, or a ductile iron. As shown in FIG. 1, the stem 200 is provided with a first stem end 201, a second stem end 220, an outer stem surface 202, and a stem axis 203. As depicted in FIG. 13, the first stem end 201 is provided with at least one groove, such as groove 206. The second stem end 220, shown in FIG. 1 includes an eye 222 and is shaped to receive an arm 61. In an alternative embodiment, the stem 200 is fabricated without the eye 222. The first stem end 201 is shaped to fit through the opening 104 of the first coupler end 102. In the embodiment, depicted, the stem axis 203 is generally coaxial with the coupler axis 101.

Figure 18:
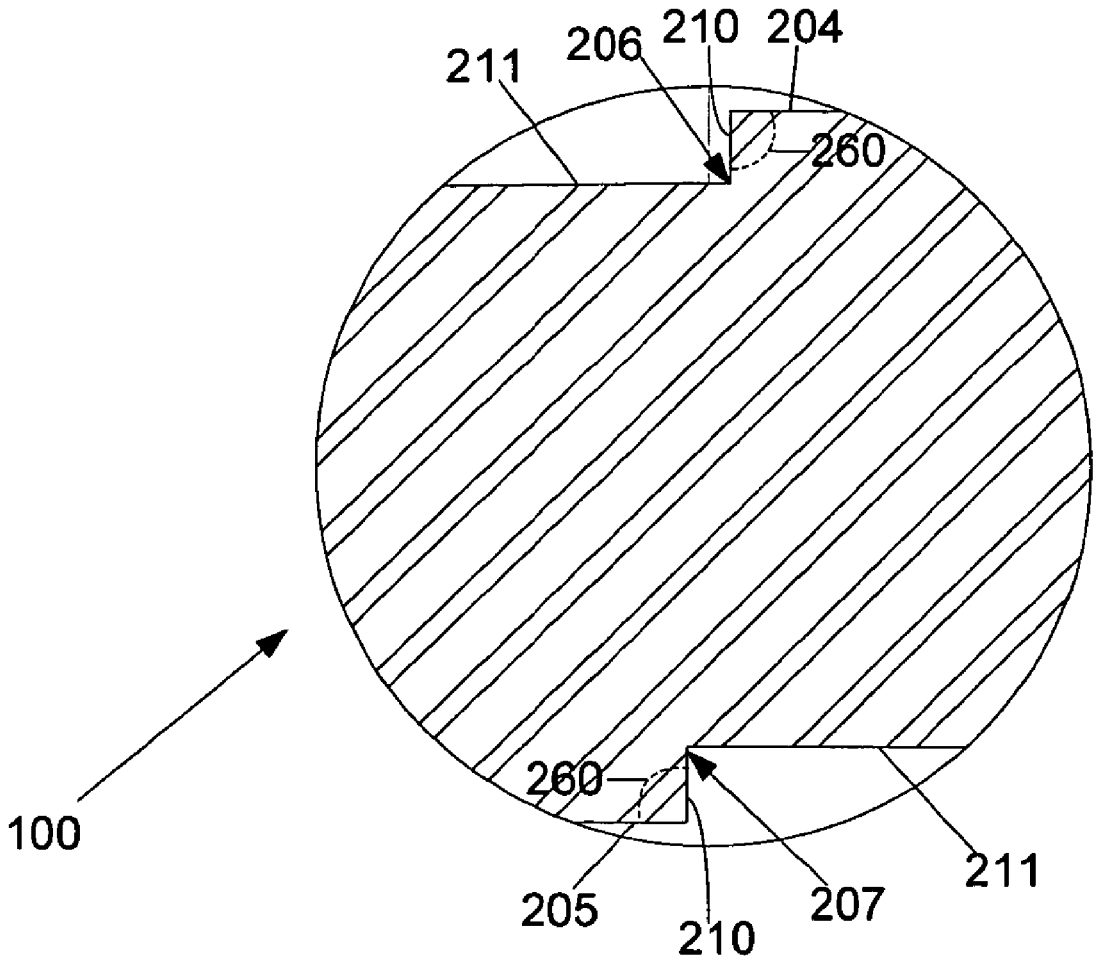
FIG. 18 depicts a cross-sectional view of the stem of the preferred embodiment.

As shown in FIG. 13, the stem 200 is preferably provided with a pair of grooves 206, 207 that are located opposite to each other on the outer stem surface 202. As shown in FIG. 18, each respective groove 206, 207 is located adjacent to a retaining surface 204 or 205. As shown in FIG. 13, the stem 200 is provided with a groove radius 209 that is measured from the coupler axis 103 to one the grooves 206, 207.

Figure 15:
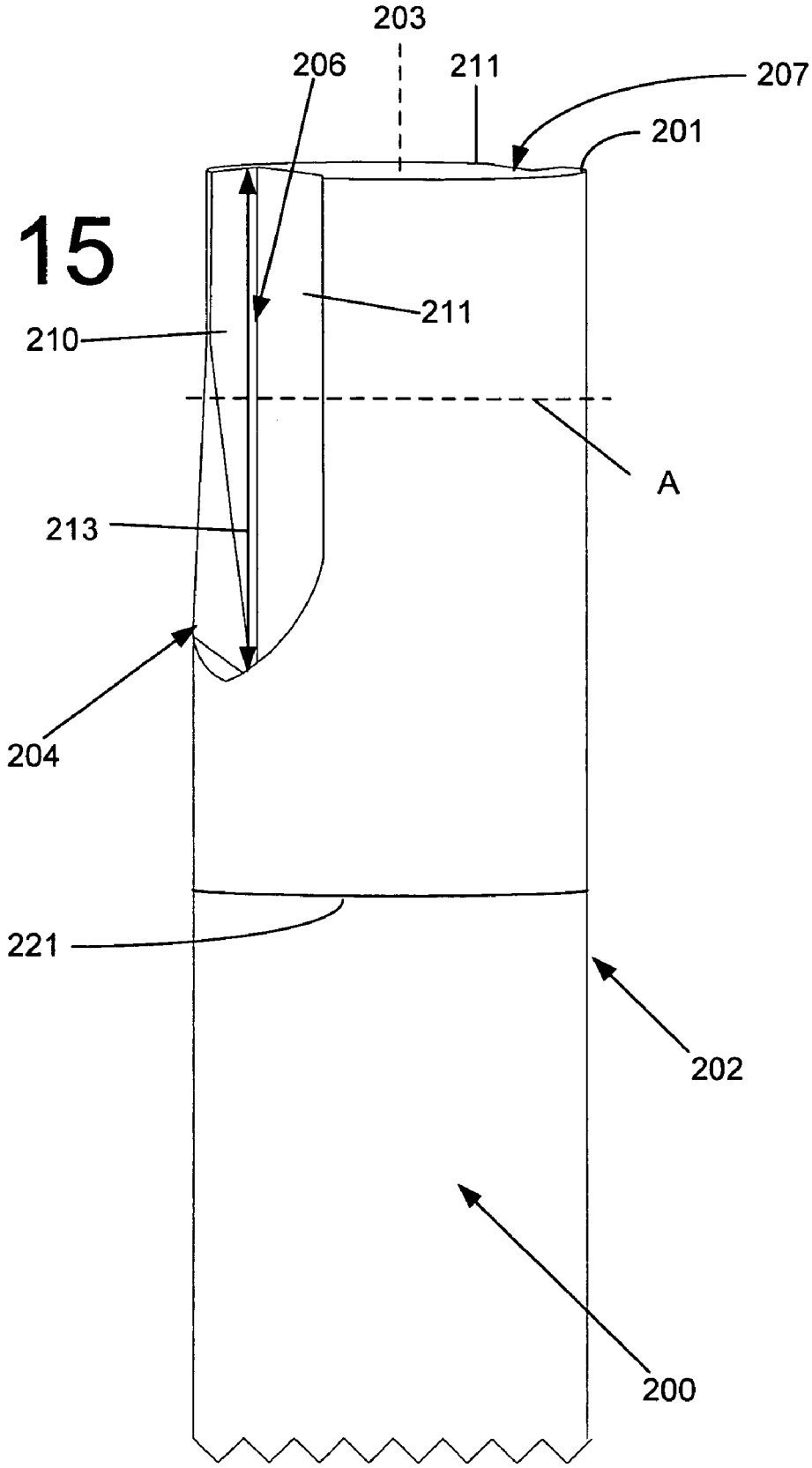
FIG. 15 depicts a side perspective view of the stem of the preferred embodiment.

In the presently preferred embodiment depicted in FIGS. 13 and 15, the grooves 206, 207 are provided with a first wall 210 and a second wall 211. FIG. 13 shows the first wall 210 abutting the second wall 211 at an angle 212 so that the grooves 206, 207 define a generally triangular cross-sectional area that is dimensioned to accept the retaining member 130 or 131. Preferably, the angle 212 between the first wall and the second wall 211 measures 90°.

Referring now to FIG. 15, the grooves 206, 207 extend axially into the stem 200 from the first stem end 201 a groove distance 213 that preferably measures 1 inch. According to one aspect, the grooves 206, 207 are dimensioned according to the inner surface 120 of the coupler 100. According to another aspect, the grooves 206, 207 are dimensioned according to the retaining members 130, 131 located on the inner surface 120 of the coupler 100. Preferably, the groove distance 213 is dimensioned according to the axial length 137 of the first surface 132 of the retaining members 130, 131.

Figure 14:
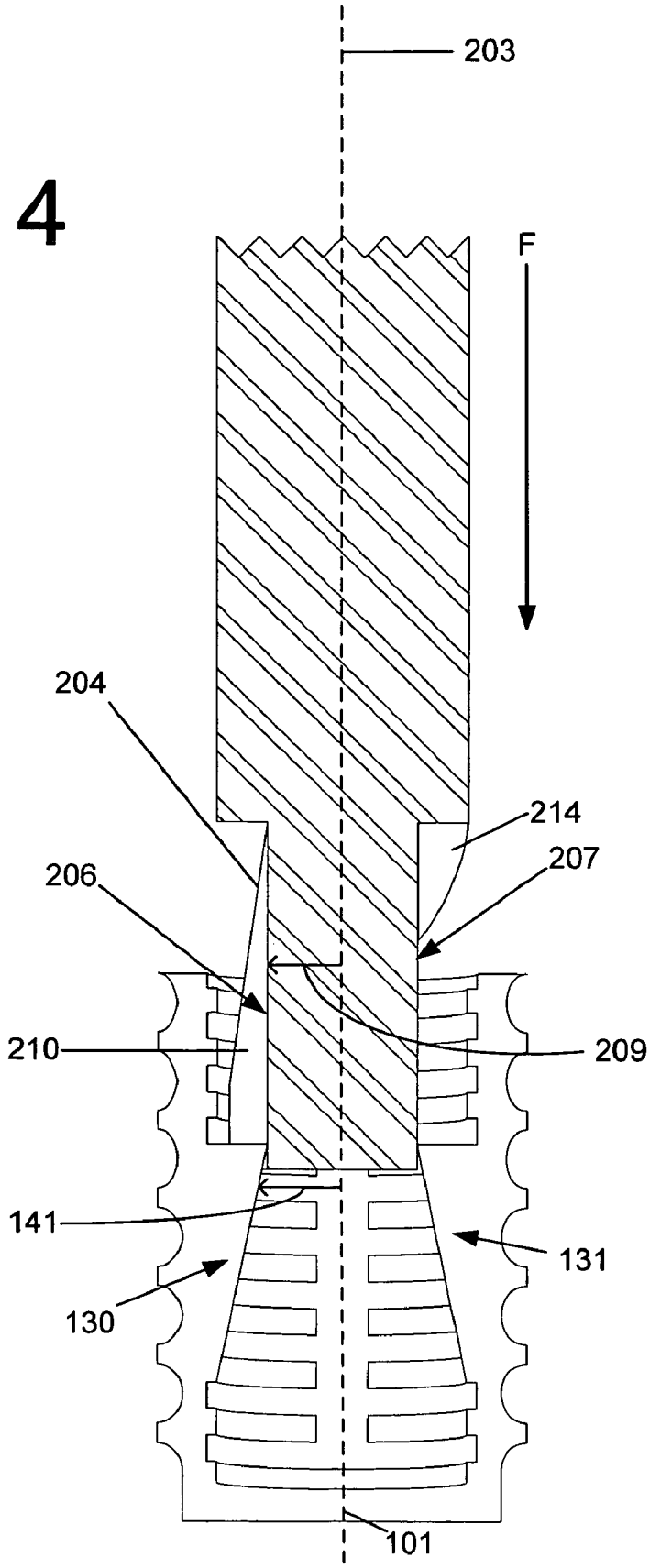
FIG. 14 depicts a cross-sectional view of a coupler and stem of the preferred embodiment.

According to yet another aspect, the grooves 206, 207 are dimensioned so that the inner surface 120 of the coupler 100 slidably accepts at least a portion of the stem 200. According yet another aspect, the grooves 206, 207 are dimensioned so that the retaining members 130, 131 slide axially within the grooves 206, 207. FIG. 14 depicts the coupler 100 and the stem 200 in cross section and shows the retaining members 130, 131 positioned so that the coupler 100 slides axially onto the stem 200. As depicted, the coupler 100 is oriented radially so that the retaining members 130, 131 fit within the grooves 206, 207 on the stem 200. Advantageously, as shown in FIG. 14, the coupler radius 141 is dimensioned to be greater than or equal to a groove radius 209.

Figure 16:
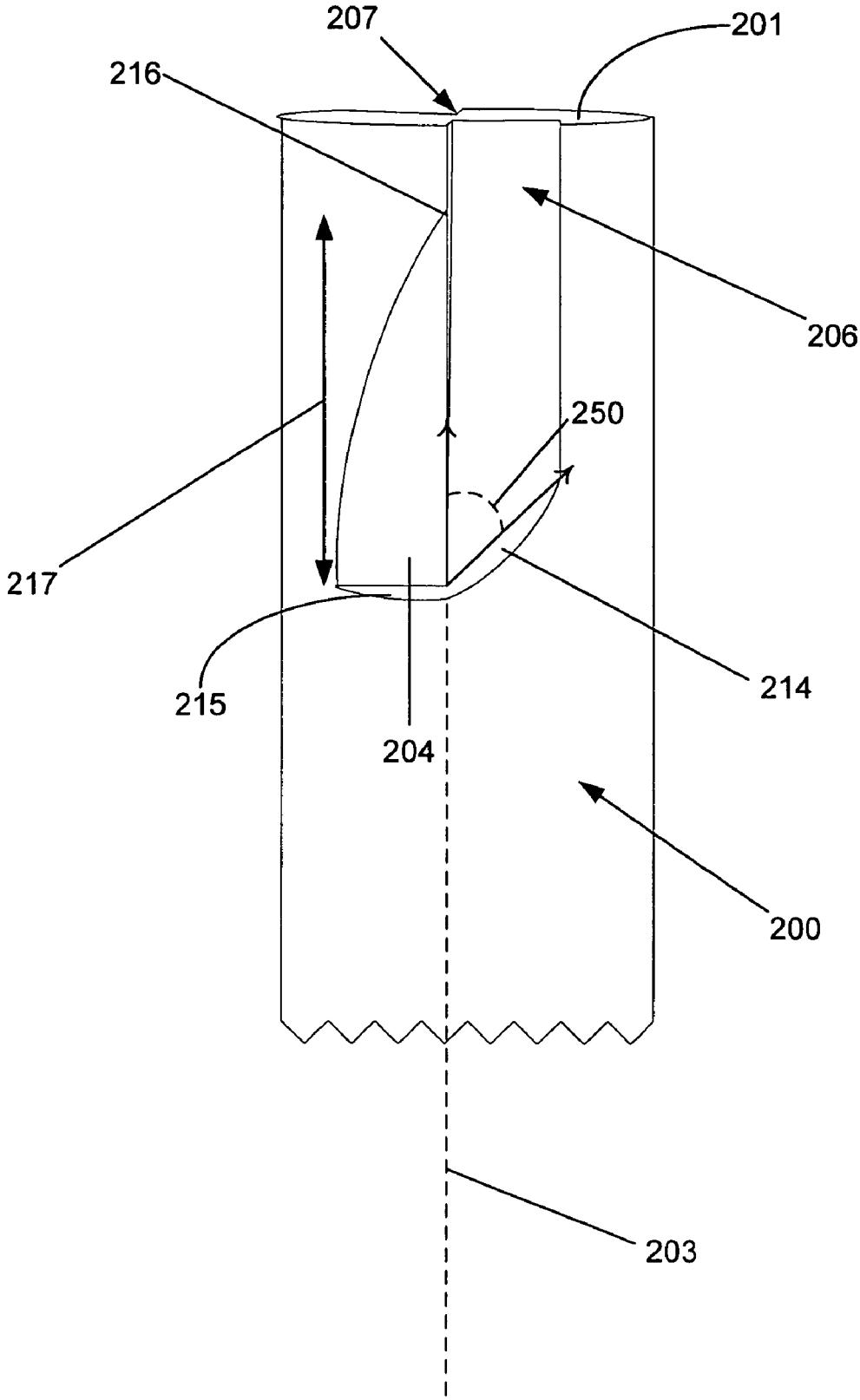
FIG. 16 depicts a side perspective view of the stem of the preferred embodiment.

Located within the grooves 206, 207 is a guide surface 214 that is configured to orient the coupler 100 so that the retaining members 130, 131 contacts a respective retaining surface 204 or 205 located on the stem 200. As the stem 200 is moved axially into the coupler 100, each of the retaining members 130, 131 eventually reach a guide surface 214. The guide surface 214 is shaped so that the insertion force F, depicted in FIG. 14, which is substantially axial in direction is translated into a radial direction. At a minimum, the guide surface 214 is shaped so that the insertion force is both axial and radial in direction. As shown in FIG. 16, the guide surfaces 214 of the preferred embodiment are located at an angle 250 relative to the stem axis 203 that is greater than 0° but less than 90°, preferably 45°.

Figure 12:
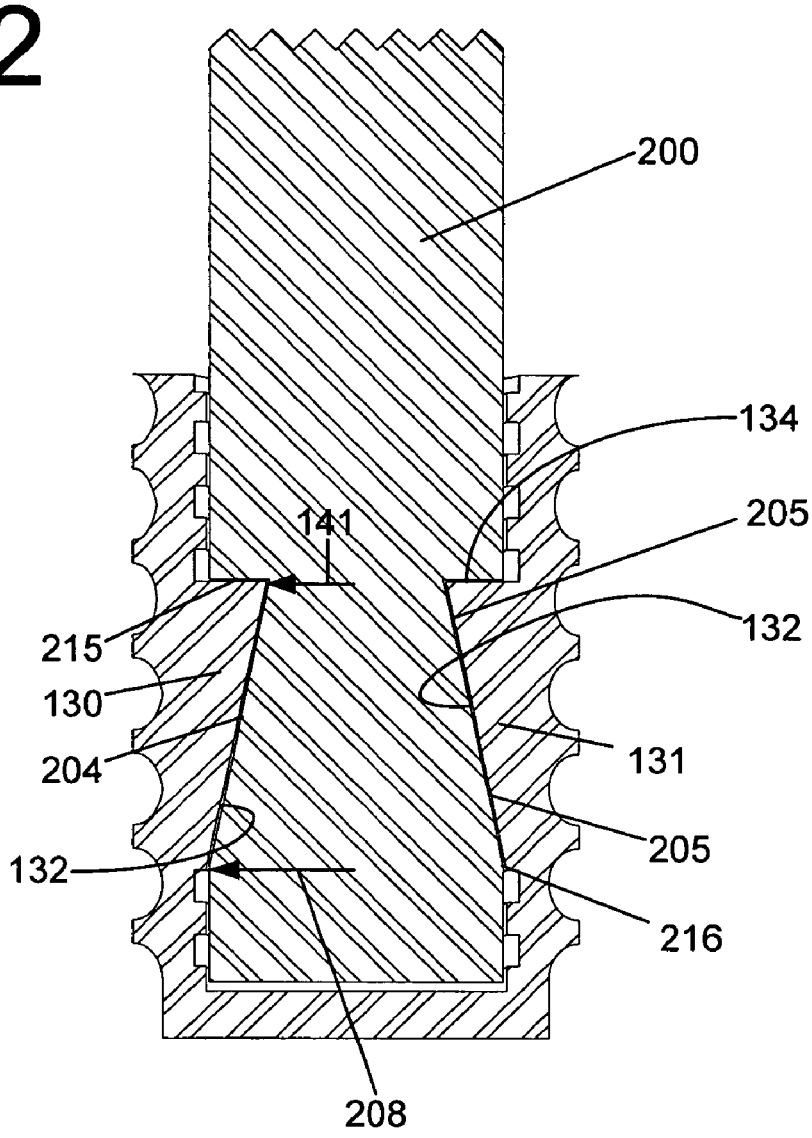
FIG. 12 depicts a cross-sectional view of a coupler and stem of the preferred embodiment.

The guide surface 214 is shaped to orient the coupler 100 during insertion of the stem 200 so that the first surface 132 of the retaining members 130, 131 contacts a respective retaining surfaces 204, 205 on the stern 200. Advantageously, the radial component of the insertion force results in relative rotation between the coupler 100 and the stem 200. As shown in FIG. 12, the relative rotation results in contact between the first sides 132 of the retaining members 130, 131 and the respective retaining surfaces 204, 205 on the stem 200.

Figure 17:
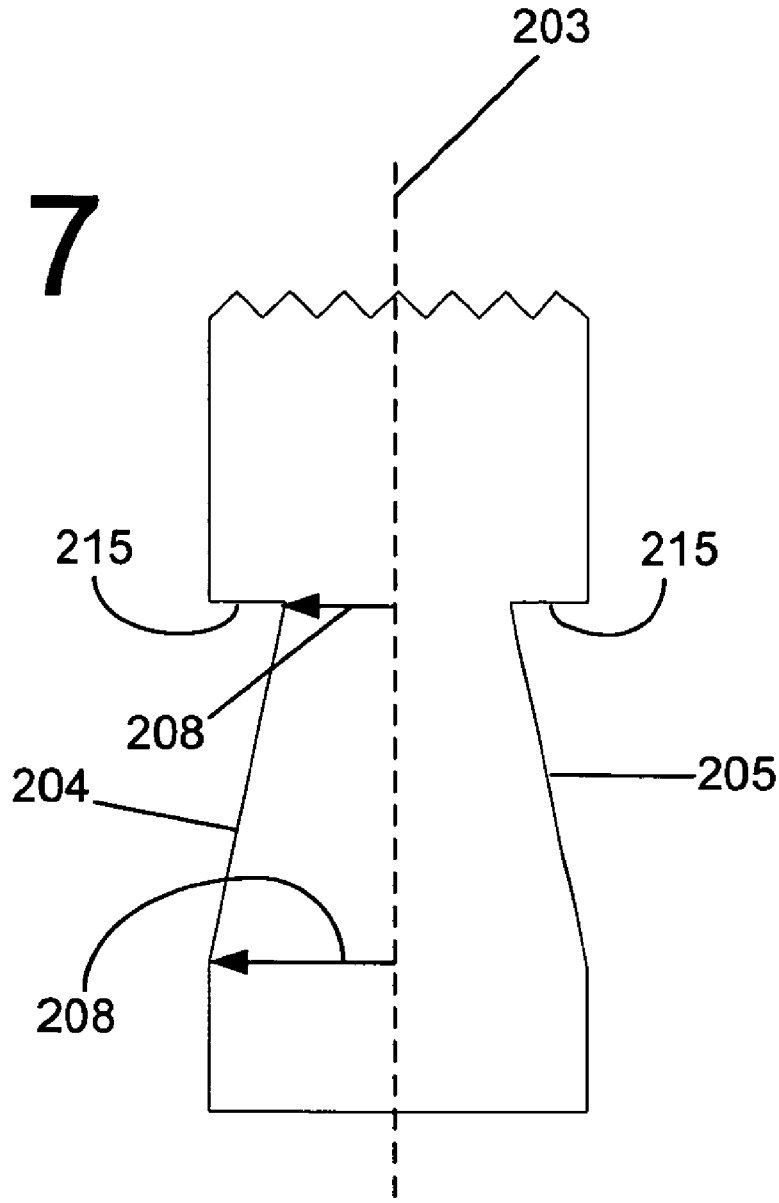
FIG. 17 depicts a cross-sectional view of the stem of the preferred embodiment.

As shown in FIGS. 17 and 18, the stern 200 is preferably provided with a pair of retaining surfaces 204, 205 that are located opposite to each other on the outer stern surface 202. The stem 200 is also provided with a retaining radius 208 that is measured from the stem axis 203 to one of the retaining surfaces 204, 205. As shown, the retaining radius 208 increases towards the first stem end 201.

FIG. 18 depicts the stem 200 a top cross-sectional view along line A in FIG. 15. As shown in FIG. 18, retaining surfaces 204, 205 abut the first walls 210 of the respective grooves 206, 207 at an angle 260 that preferably measures 90°. In alternative embodiments, the angle 260 between the retaining surface 204 and the first wall 210 measures less than 90°.

As shown in FIG. 16, the retaining surfaces 204, 205 extend axially toward the first stem end 201 from a stem shoulder 215 to a termination point 216. In the preferred embodiment, the retaining surfaces 204, 205 extend a retention distance 217 that preferably measures from 0.20 of an inch to 1 inch, advantageously 0.75 inches. The retention distance 217 is dimensioned according to the axial length 137 of the first surface 132 of the retaining members 130, 131.

As shown in FIG. 12, the retaining surfaces 204, 205 are angled so that the retaining radius 208 increases towards the first stem end 201. The retaining surfaces 204, 205 flare away from the stem axis 203 as they extend axially toward the first stem end 201. In the preferred embodiment, the retaining radius 208 along the retention distance 217 is greater than or substantially equal to the coupler radius 141 at the third surface 134.

Referring back to FIG. 12, the retaining surfaces 204, 205 of the stem 200 and the first surface 132 of the coupler 100 are configured to prevent axial motion between the stem 200 and the coupler 100 when axial forces are applied to either the stem 200 or the coupler 100. In the preferred embodiment, the retaining surfaces 204, 205 are angled relative to the stem axis 203 so that the retaining radius 208 increases toward the termination point 216 to become greater than the coupler radius 141. As a result, the coupler 100 and the stem 200 interlock and the coupler 100 cannot be axially separated from the stem 200 when the first surface 132 of the retaining members 130, 131 is in contact with the retaining surfaces 204,205 on the stem 200. Advantageously, the retaining surfaces 204, 205 are angled correspondingly to the first surface 132 of the retaining members 130, 131. In the presently preferred embodiment, the angle between the stem axis 203 and the retaining surfaces 204, 205 is greater than 0° and less than 90°, preferably less than 30°. However, in the alternative embodiment, the angle between the retaining surfaces 204, 205 and the stem axis 203 is greater than 90°.

As depicted in FIG. 15, the stem 200 is provided with an indicator 221. The indicator 221 extends radially about the stem axis 203. In the preferred embodiment, the indicator is a ridge; however, in an alternative embodiment, the indicator 221 is a depression. The indicator 221 provides a reference point that indicates when the retaining members 130, 131 engage the retaining surfaces 204, 205 on the stem 200.

While this invention has been particularly shown and described with references to preferred embodiments thereof, it will be understood by those skilled in the art that various changes in form and details may be made therein without departing from the spirit and scope of the invention as defined by the appended claims.

I claim:

1. A coupler stem assembly, comprising:

a) a coupler that includes:

i) polymer material that has been molded to a predetermined shape;

ii) an outer surface that is threaded and provided with a coupler axis;

iii) an inner surface that defines a cavity and that includes a retaining member; and b) a stem that includes:

i) an outer stem surface that is provided with a stem axis and that is shaped to fit within the cavity defined by the inner surface of the coupler; and ii) a retaining surface that is located on the outer stem surface and shaped to engage with the retaining member of the inner surface of the coupler, wherein the stem further comprises a groove and a guide surface that are located on the outer stem surface, the groove is dimensioned to accept the retaining member and the guide surface is configured to orient the coupler so that the retaining member contacts the retaining surface on the stem.

2. A coupler stem assembly according to claim 1, wherein the retaining member is in contact with the retaining surface.

3. A coupler stem assembly according to claim 1, further comprising an adhesive that occupies at least a portion of the cavity.

4. A coupler stem assembly according to claim 1, wherein the stem further comprises a groove located on the outer stem surface that is dimensioned to accept the retaining member.

5. A coupler stem assembly according to claim 1, wherein the stem further comprises a guide surface located on the outer stem surface that is configured to orient the coupler so that the retaining member contacts the retaining surface.

6. A coupler stem assembly, comprising:

a) a coupler that has been molded from a polymer material and that includes:

i) a coupler axis;

ii) an outer surface that is shaped to be secured to an insulator;

iii) an inner surface that includes a ridged surface located radially about the coupler axis;

iv) a coupler end that is provided with an opening;

b) a stem that includes:

i) a first stem end that, at least in part, is shaped to fit through the opening of the coupler end;

ii) a second stem end that is shaped to receive an arm;

iii) a stem axis that is generally coaxial with the coupler axis; and iv) an outer stem surface that includes a retaining surface that flares away from the stem axis as it extends axially toward the first stem end, wherein the stem further comprises a groove and a guide surface that are located on the outer stem surface, the groove dimensioned to accept a retaining member and the guide surface is configured to orient the coupler so that the retaining member contacts the retaining surface on the stem.

7. A coupler stem assembly according to claim 6, wherein a retaining member is in contact with the retaining surface.

8. A coupler stem assembly according to claim 6, further comprising an adhesive that occupies at least a portion of a cavity that is defined by the inner surface.

9. A coupler stem assembly according to claim 6, wherein the stem further comprises a groove located on the outer stem surface that is dimensioned to accept a retaining member.

10. A coupler stem assembly according to claim 6, wherein the stem further comprises a guide surface located on the outer stem surface that is configured to orient the coupler so that a retaining member contacts the retaining surface.

* * * * *